United States Patent [19]

Harvey et al.

[11] B 4,000,970

[45] Jan. 4, 1977

[54] DYEING PROCESS

[75] Inventors: Edwin Dennis Harvey; David Melville Fawkes; Denis Ronald Lemin; James Anthony Hawkes, all of Manchester, England

[73] Assignee: Imperial Chemical Industries Limited, London, England

[22] Filed: Aug. 17, 1973

[21] Appl. No.: 389,155

[44] Published under the second Trial Voluntary Protest Program on March 30, 1976 as document No. B 389,155.

[52] U.S. Cl. ..... 8/178 R; 8/173; 8/176; 8/178 E

[51] Int.'Cl.² ..... D06P 3/24

[58] Field of Search ..... 8/178 R, 178 E, 173, 8/176

[56] References Cited

UNITED STATES PATENTS 3,667,898 6/1972 Bergman et al. ..... 8/94

FOREIGN PATENTS OR APPLICATIONS 1,103,860 2/1968 United Kingdom ..... 8/178 R

*Primary Examiner*—M. J. Welsh

*Attorney, Agent, or Firm*—Cushman, Darby & Cushman

[57] ABSTRACT

A process for the batdhwise dyeing of polyamide textile materials which comprises treating said material in an aqueous dye liquor containing not more than 10% by volume of at least one organic liquid capable of forming an azeotrope with water and an anionic dye, said dye liquor being maintained during at least part of the treatment at a temperature higher than the boiling point of said azeotrope and under a pressure greater than atmospheric pressure, and then recovering the organic liquid, by distillation before removing the textile material from the aqueous dye liquor.

9 Claims, No Drawings

DYEING PROCESS

This invention relates to a dyeing process and more particularly to a process for the dyeing of polyamide textile materials.

It is known to color natural and synthetic polyamide textile materials with acid dyes from aqueous dyebaths. However, in the majority of cases with synthetic polyamides this results in dyeings having only moderate wet-fastness properties and in order to achieve an improvement with these dyes it is often necessary to resort to lengthy, expensive and inconvenient back-tanning treatments. High wet-fastness properties are becoming increasingly desirable and can be achieved without a back-tanning after-treatment by using larger dye molecules typified by the sulphonated phthalocyanines, acid metal complex dyes, acid dyes containing more than one sulphonic acid group, certain monosulphonated acid dyes and certain fibre-reactive acid dyes. However, the majority of such dyes are difficult to apply, often because of their slow diffusion rates, and the resulting dyeings are frequently unlevel and subject to the defect known as barriness. In many cases the build-up is only poor to moderate and the fibre is incompletely penetrated.

The aforesaid difficulties are aggravated when the synthetic polyamide textile material contains a high level of physical irregularity and the inability of many acid dyes to produce commercially acceptable dyeings in such cases places a heavy burden on both the dyer and the fibre manufacturer in terms of quality control. The difficulties involved in achieving acceptable results often lead to expensive compensation claims against the dyer and fibre manufacturer.

Difficulties are also encountered in the dyeing of natural polyamide textiles such as wool and silk. For example when using high molecular weight dyes, problems can be encountered due to the fact that the dyes are adsorbed non-uniformly on fibres possessing slight physical and chemical differences.

A number of modifications to the dyeing process have been proposed with the object of overcoming these difficulties experienced with natural and synthetic polyamide but the modified processes have not been entirely successful.

It has now been found that the exhaust dyeing of natural and synthetic polyamide textile materials with anionic dyes in an aqueous dyebath containing a small amount of a volatile organic solvent under specified conditions of temperature and pressure unexpectedly leads to a significant improvement in levelling and the coverage of irregular textile material and also an improvement in the build-up of certain dyes. This process enables synthetic polyamide textile materials with a high degree of physical irregularity, and which have hitherto been unacceptable, to be dyed to a commercially acceptable degree of levelness and coverage of barriness and natural polyamides to be dyed with improved coverage of physical and chemical differences between the individual fibres in any sample.

The inclusion of small amounts of organic liquids in aqueous dye liquors has already been proposed and while the use of such liquids produces advantages it also brings problems associated with the cost of the organic liquid and its subsequent presence in the dyed textile material. Thus, any organic liquid absorbed by the textile during the dyeing process can be released during subsequent high temperature treatments such as drying processes. The release of such organic liquids in vapor form from the dyed textile material is undesirable because of the potential fire hazard, the exposure of operatives to health risk, the creation of environmental pollution and the possibility of causing migration of dye to the fibre surface. In some cases the organic liquid may be released slowly from the dyed material during storage or marketing of the dyed goods leading to objectionable odors and vapors which may be injurious to health. Additionally, of course, the disposal of dyebath liquors containing organic liquids causes problems because the liquids are relatively costly materials to discard and because their disposal can cause environmental pollution.

The present invention, according to which recovery of the organic liquid is an integral part of the dyeing process, permits the use of organic liquids in the dyeing of polyamide textiles while minimizing the above-mentioned difficulties previously associated with their use.

Thus, according to the present invention, there is provided a process for the batchwise dyeing of polyamide textile materials which comprises treating said material in an aqueous dye liquor containing not more than 10% by volume of at least one organic liquid capable of forming an azeotrope with water and an anionic dye, said dye liquor being maintained during at least part of the treatment at a temperature higher than the boiling point of said azeotrope and under a pressure greater than atmospheric pressure, and then recovering the organic liquid by distillation before removing the textile material from the aqueous dye liquor.

Polyamide textile materials which may be dyed by the process of the invention include, in particular, synthetic polyamides such as polyhexamethylene adipamide and polycaprolactam fibres which may be in any textile form and natural polyamides such as wool and silk.

Anionic dyes which may be used in the process of the invention have been fully described in the prior art. Examples of suitable anionic dyes include the acid dyes which may optionally contain fibre-reactive groups, for example monochlorotriazinylamino, dichlorotriazinylamino and acryloylamino groups, and/or complexed metal atoms such as chromium, cobalt or copper. For examples of suitable acid dyes, reference may be made to The Colour Index, 3rd Edition (published 1971 by the Society of Dyers and Colourists) at pages 1001–1561.

The process of the invention is of particular utility for the application of those acid dyes known to have poor migration or levelling properties when applied to a polyamide textile material by a conventional dyeing process. The classification of acid dyes in terms of their levelling properties is well known to those skilled in the art. Thus, in a wool dyeing context it is conventional to classify acid dyes as acid levelling dyes or acid milling dyes and it is the dyes of the latter class which are particularly advantageously applied to natural or synthetic polyamide textile materials by the process of the present invention. When applied to wool by a conventional dyeing process, the acid milling dyes are generally applied from a nearly neutral or weakly acid dyebath and accordingly the Colour Index Categorizes acid dyes by their method of application. The classification of acid dyes in terms of their ease of levelling is also discussed at pages 11–14 of "Whitaker's Dyeing with Coal-Tar Dyestuffs" Sixth Edition by C. C. Wilcock and J. L. Ashworth, published 1964 by Bailliere, Tindall and Cox. While the foregoing relates largely to a wool dyeing context it is also known to those skilled in the art that acid dyes show variations in levelling properties when applied to nylon by conventional dyeing techniques. In general, the dyes which exhibit poor levelling properties on wool, the acid milling dyes, also exhibit poor levelling properties on nylon and this shows up particularly as a tendency to emphasize fibre irregularities. Thus, acid dyes which have poor migration or levelling properties on wool and/or nylon can readily be identified by reference to the Colour Index, textbooks and pattern cards issued by the various dyestuff manufacturers. Additionally, various levelling and migration tests have been described in the literature for distinguishing between different types of acid dyes.

Among the various chemical classes of acid dyes which may advantageously be applied to polyamide textile materials by the process of the invention there may be mentioned the 1:2-metal complexes of azo dyes and the sulphonated phthalocyanines.

Other useful anionic dyes include the direct dyes. For examples of suitable direct dyes, reference may be made to pages 2005–2477 of the Colour Index.

The organic liquids which are used in the process of the invention preferably have low solubilities in water that is to say solubilities of not more than 10% on a weight basis at room temperature. Preferably, the amount of organic liquid present in the dye liquor should not exceed its aqueous solubility under the conditions of dyeing and most suitably it is between 0.1 and 7%, preferably between 9.1 and 5%, by volume. It is also preferred to use organic liquids which form azeotropes with water boiling below 100°C at atmospheric pressure and the azeotrope should be of such composition that the vapor phase is rich in the organic liquid, In addition the organic liquid should be capable of dissolving the dye to some extent and of wetting the polyamide textile material. Since it is a feature of the invention to recover the organic liquid as an integral part of the dyeing process, the liquid should be stable under the conditions of dyeing so that it may be recovered unchanged in high yield.

Suitable organic liquids include alcohols, for example n-butanol, sec-butanol, amyl alcohol, 3-pentanol, 4-methyl-2-pentanol and hexanol, ketones, for example acetone, ethers, for example di-iso-propyl ethers and esters, for example ethyl acetate, iso-propyl acetate, butyl acetate and ethyl propionate. Mixtures of liquids may be used, for example mixtures of two liquids which together with water form a ternary azeotrope.

The preferred organic liquid is n-butanol and the preferred dyeing temperature is in the range 100°–130°C.

In addition to the organic liquid, the aqueous dye liquor may also contain conventional dyebath additives associated with the batchwise dyeing of polyamide textile materials. Such additives include organic acids and their salts.

At the end of the dyeing process but before removing the polyamide textile from the dye liquor, the organic liquid is recovered for re-use. It may be recovered by lowering the dyebath temperature to that of the azeotropic boiling point and distilling off the azeotrope. Conveniently, distillation is carried out while the dyebath is held at dyeing temperature by venting the vapors to a condenser held at atmospheric pressure or to an enclosed condenser which is allowed to attain the superatmospheric pressure existing in the dyeing vessel. Distillation is preferably continued until the residual dye liquor is substantially free from the organic liquid.

The condensed vapors may be separated into their components, water and organic liquid, by any suitable means. If desired, the volume of dye liquor may be maintained at a constant level by returning the water or the water-rich phase of the recovered distillate after separation or by pumping in a fresh supply of water. Alternatively, the volume of dye liquor may be allowed to fall as distillation proceeds. Preferably, the total condensate is used, without separation, in a subsequent dyeing process.

In a modified form, the process of the invention may be used for the correction of uneven dyeings on polyamide textile materials. To effect correction, the dyed material is treated in the aqueous dye liquor containing the organic liquid and optionally an anionic dye.

The invention is illustrated but not limited by the following Examples 1–9, 11–15 and 17–29 in which all parts are by weight. Examples 10 and 16 which are not illustrative of the invention are included for the purpose of comparison.

EXAMPLE 1

300 parts water, 15 parts n-butanol, 20 parts nylon 6.6 fabric and 0.2 part C.I. Acid Blue 185 in the form of Coomassie Turquoise Blue 3G are placed in an autoclave which is fitted with a stirrer, and also a needle valve connected to a water condenser. The sealed autoclave is heated with stirring over 40 minutes to a temperature of 120°C, and maintained at this temperature for a further 30 minutes. The needle-valve is then carefully opened and the butanol-water azeotrope distilled from the dyebath liquor. After recovery of approximately 95% of the butanol, the autoclave is cooled, opened and the fabric removed, washed well with water and finally dried. A bright, level fully penetrated turquoise dyeing is obtained with excellent coverage.

EXAMPLE 2

A stainless steel dyeing vessel in the form of an autoclave which is fitted with a needle valve connected to a condenser, a distillate receiver and means of stirring is charged with 64 parts of water, 3.2 parts of n-butanol, 0.06 part of ammonium acetate, 0.02 part of C.I. Acid Blue 140 in the form of Nylomine Blue C-3R and 2.0 parts of knitted nylon 6.6. material.

The nylon material is knitted from two yarns having a difference in draw ratio of about 12% in such a way as to produce a fabric having alternating half-inch wide longitudinal and adjacent stripes comprised of each yarn. The fabric then contains stripes which differ in the degree of physical regularity by 12%. As such, fabric of this type is used in the test dyeing of nylon to demonstrate the ability of any dye or associated dyeing process to cover physical irregularities which occur in commercial textile materials and which are known as barriness. Barriness often manifests itself at the end of a dyeing process by the appearance of stripes or bars of noticeable shade difference, which, in most cases, is commercially undesirable.

The nylon is then gently agitated in the dye liquor, the dyeing vessel is sealed, the temperature is raised to 120°C over 40 minutes and held at this temperature for a further 30 minutes. At this stage, the needle valve is carefully opened, regulated and controlled to allow the butanol and water vapor to be vented to a condenser where the vapor is cooled, condensed and collected. Distillation of the binary azeotrope of butanol and water is then continued at a dyebath temperature of 120°C until tests on the vapor emerging from the dyeing vessel indicate a complete transfer of butanol to the condensate receiver and storage vessel.

The dyeing liquor and contained nylon are then cooled to a temperature below 100°C and the exhausted dyebath liquor is then drained off to storage.

The dyed nylon is rinsed with fresh water and the rinse liquors are also drained off to storage.

Examination of the materials used, reveals that the nylon is level dyed and that remarkable and unexpectedly good coverage of the known and gross physical irregularities in the nylon yarn is obtained. The component yarns of the dyed fabric are seen by microscopic examination of their transverse and lateral crosssections to be fully and levelly penetrated by the applied dye.

Analysis of the dyed nylon by known methods of gas-liquid chromatography indicates a complete absence of absorbed n-butanol. Testing of the dyed nylon to requirements such as resistance to fading on exposure to light, freedom from staining in perspiration, washing and rubbing tests are all excellent. Such tests are described in "Standard Methods for the Determination of the Colour Fastness of Textiles" by the Society of Dyers and Colourists.

Physical testing of the dyed nylon yarn shows that acceptable performance is retained during dyeing and that no unacceptable or adverse effects have thereby been produced.

The dyed nylon can then safely be subjected to normal heat-setting treatments using dry heat or steam without any risk of liberating harmful or noxious solvent vapors. If the fabric is carrier dyed in a normal fashion without practising the integrated and solvent recovery process of the invention, then harmful and noxious vapor is produced during subsequent heat setting.

Examination of the recovered aqueous butanol by gas-liquid chromatography indicates a quantative recovery of butanol in a chemically unchanged state and in a suitable form for recycling in the process as described in Example 3 without further treatment.

Analysis of the spent dye liquors from the process of this Example indicates freedom from retained butanol and very low level of residual unused dyestuff. The spent liquors may safely be recycled as described in Example 3 or if desired, discharged direct to drainage without intermediate purification and without harmful environmental side effects or danger to operatives. Similarly, the washing or rinsing liquors are in a pollution-free state and may safely be recycled as described in Example 3 or alternatively discharged to drains. Taken collectively, these observations indicate a considerable cost saving to the dyer in terms of speed, safety and efficiency of processing. Where carriers are already used and discarded in aqueous processing the process of the invention can be used with advantage to reduce considerably the cost of carrier purchase, to reduce the cost of waste liquor treatment and to eliminate the risk of pollution and of environmental hazards during processing or as may subsequential be caused by the normally practised use of carrier solvents and their disposal.

Compared to high temperature dyeing without butanol or the use of other carrier solvents, the process of the invention provides the means to produce much superior levels of barriness coverage and very level dyeings in either shorter processing times at similar temperatures or at lower temperatures in similar processing times thus fulfilling a much felt need in the dyeing industry.

EXAMPLE 3

The stainless steel dyeing vessel as described in Example 2 is charged with the butanol/water distillate and the spent dyebath liquor from Example 2 and the total liquor is made up to 67.2 parts by the addition of a small amount of water, 0.06 part of ammonium acetate, 0.02 part of C.I. Acid Blue 140 in the form of Nylomine Blue C-3R and 2.0 parts of the special diagnostic and knitted nylon 6.6 material as described in Example 2 are introduced.

Dyeing and solvent recovery is then carried out as described in Example 2 and rinsing is carried out using the stored rinse liquor from Example 2.

Examination of the dyed nylon 6.6 reveals an excellently dyed fabric which is indistinguishable in appearance and fastness properties from that produced in Example 2.

Examination of the recovered solvent again shows no chemical change in the butanol and its quantitative recovery is indicated by gas-liquid chromatography.

Examination of spent dyebath and rinsing liquors by gas-liquid chromatography indicates freedom from butanol and optical measurements indicate a very low level of unutilized and residual dye. These liquors are in a fit state for disposal or may be stored for re-use.

EXAMPLE 4

Example 2 is repeated except that at the end of the 30 minutes dyeing period, the temperature is lowered to 90°C and the needle valve to the condenser is fully opened to allow conditions of atmospheric pressure to exist in both the dyeing vessel and the condenser system. The temperature is then raised and distillation of the butanol-water azeotrope is commenced at 93°C. Distillation is continued until the temperature of the emerging vapor which is being condensed reaches 100°C. At this stage the emerging vapor is sampled and analyzed by gas-liquid chromatography, the vapor is free from butanol and the dyeing/solvent recovery is terminated. After cooling, draining of spent dye liquor and rinsing with fresh water, the total materials of the process are analyzed. Similiar excellent results to those of Example 2 are obtained.

EXAMPLE 5

Example 2 is repeated except that at the end of the 30 minutes dyeing period, the temperature of the dye liquor is maintained at 120°C and the needle valve is opened to a condenser system that is closed to the atmosphere. The pressure in the dyeing vessel and in the condenser system is allowed to equalize and the condenser cooling system is then brought into operation. Distillation is then continued under pressure at 120°C until 10 parts of condensed distillate is collected and the temperature of the remaining dye liquor is then reduced to below 90°C and drained to storage. The dyed fabric is then rinsed with fresh water. The total materials of the process are then analyzed with similar excellent results to those obtained in Example 2.

EXAMPLE 6

Example 2 is repeated except that in place of 0.02 part C.I. Acid Blue 140 there is used 0.02 part of C.I. Direct Blue 71 in the form of Durazol Blue 2R.

Excellent coverage of the physical irregularities in the nylon 6.6 material and very level dyeing is obtained. The indicated recovery of n-butanol is quantitative, dye utilization is high and the spent dyebath liquors are in a fit state for disposal or re-use.

EXAMPLE 7

Example 2 is repeated except that in place of 0.02 part of C.I. Acid Blue 140 there is used 0.02 part of C.I. Reactive Black 12 in the form of Procilan Grey BR.

Excellent coverage of the physical irregularities in the nylon 6.6 material and very level dyeing is obtained, the indicated recovery of n-butanol is quantitative, dye utilization is high and the spent dyebath liquors are in a fit state for disposal or re-use.

EXAMPLE 8

Example 2 is repeated except that in place of 0.02 part of C.I. Acid Blue 140 there is used 0.02 part of C.I. Acid Orange 51 in the form of Nylomine Brown C-R.

Excellent coverage of the physical irregularities in the nylon 6.6 material and very level dyeing is obtained, the indicated recovery of n-butanol is quantitative, dye utilization is high and the spent dyebath liquors are in a fit state for disposal or re-use.

EXAMPLE 9

Example 2 is repeated except that in place of the 0.02 part of C.I. Acid Blue 140 there is used 0.02 part of C.I. Acid Blue 113 in the form of Nylomine Navy C-2R.

Perfect coverage of the physical irregularities in the nylon 6.6 material and very level dyeing is obtained. The indicated recovery of n-butanol is quantitative, dye utilization is high and the spent dyebath liquors are in a fit state for disposal or re-use.

EXAMPLES 10–15 INCLUSIVE

Example 2 is repeated except that in place of the 0.02 part of C.I. Acid Blue 140 there is used 0.02 part of C.I. Acid Blue 185. Each of six experiments is carried out using a different amount of n-butanol as follows:

| Example | n-butanol weight on weight of dyebath |
|---|---|
| 10 | 0% |
| 11 | 1% |
| 12 | 2.5% |
| 13 | 4% |
| 14 | 5% |
| 15 | 6% |

Comparison of the six dyeings obtained from Examples 10–15 inclusive reveals that coverage of the known physical irregularities in the nylon improves with increasing butanol usage and reaches an optimum at 5% by weight of butanol on weight of dyebath. Below this usage of butanol, the coverage of the physical irregularities in the nylon improves with increasing butanol usage, above 5% weight of butanol on weight of dyebath gives no further improvement in coverage which is, by this stage, virtually perfect.

EXAMPLES 16–26

Example 2 is repeated but instead of 3.2 parts of n-butanol there are used 3.2 parts of the compound cited in column 2 of Table I.

TABLE I

| Example | Organic Liquid | Coverage |
|---|---|---|
| 16 | None | Poor |
| 17 | Ethanol | Good |
| 18 | n-propanol | Good |
| 19 | iso-propanol | Good |
| 20 | tert.butanol | V.Good |
| 21 | Cyclohexanol | V.Good |
| 22 | Methyl Cellosolve | Good |
| 23 | Ethyl Cellosolve | Good |
| 24 | Ethyl Acetate | V.Good |
| 25 | Acetone | Good |
| 26 | n-Butanol | Excellent. |

Examples 17–25 inclusive all give much improved coverage of physical irregularities in the nylon yarn compared with control Example 16. Example 26 (n-butanol) is outstanding good in terms of coverage, the n-butanol does not adversely affect the shade of the dyed material and its recovery and stability properties are excellent.

EXAMPLE 27

A dyebath is prepared containing 95 parts of water, 5 parts of n-butanol, 0.15 part ammonium acetate and 0.10 part of C.I. Acid Blue 185 in the form of Coomassie Turquoise 3G at 50°C and placed in a pressure dyeing vessel as is described in Example 2. 5 Parts of wool serge previously wetted with water are added, the pressure vessel is sealed and the temperature is raised to 110°C over 30 minutes. The temperature is maintained at 110°C over 30 minutes and butanol is then recovered as its binary azeotrope by distillation as is described in Example 4. The wool is finally rinsed with water and dried. A bright level dyeing is produced. The dyeing is visually stronger than that produced in the absence of n-butanol.

EXAMPLE 28

As for Example 27 but replacing the Coomassie Turquoise 3G by C.I. Reactive Red 32 in the form of Procion Rubine HBN. A level bluish-red dyeing stronger than that produced in the absence of n-butanol is obtained.

EXAMPLE 29

As Example 27 but with the addition of 0.1 part of a 40% aqueous solution of a condensate of 22 mols of ethylene oxide with cetyl/oleyl alcohols and 0.05 part of a 50% aqueous paste of cetyltrimethylammonium bromide. The dyeing produced is stronger than that of Example 27.

It will be understood by those skilled in the art that the invention is not limited by the use of the specific dyes, organic liquids, dyeing assistants, temperatures, concentrations and other conditions of dyeing and solvent recovery as given in the foregoing Examples by way of illustration. In particular, the specific dyes mentioned in the Examples can be replaced by other anionic dyes belonging to the classes hereinbefore described.

What we claim is:

1. A process for the batchwise dyeing of polyamide textile materials which comprises treating said material in an aqueous dye liquor containing not more than 10% by volume of at least one organic liquid capable of forming an azeotrope with water and an anionic dye, said dye liquor being maintained during at least part of the treatment at a temperature higher than the boiling point of said azeotrope and under a pressure greater than atmospheric pressure, and then recovering the organic liquid, by distillation before removing the textile material from the aqueous dye liquor.

2. A process as claimed in claim 1 wherein the polyamide textile material is a synthetic polyamide or wool.

3. A process as claimed in claim 1 wherein the anionic dye is an acid dye.

4. A process as claimed in claim 3 wherein there is used an acid dye known to have poor migration or levelling properties.

5. A process as claimed in claim 4 wherein there is used an acid milling dye.

6. A process as claimed in claim 1 wherein the aqueous dye liquor contains between 0.1 and 7% by volume of the organic liquid.

7. A process as claimed in claim 1 wherein the aqueous dye liquor contains between 0.1 and 5% by volume of the organic liquid.

8. A process as claimed in claim 1 wherein there is used an organic liquid which forms an azeotrope with water boiling below 100°C at atmospheric pressure.

9. A process as claimed in claim 1 wherein the organic liquid comprises n-butanol.

* * * * *